US005202079A

United States Patent [19]

Winkelmann et al.

[11] Patent Number: 5,202,079

[45] Date of Patent: Apr. 13, 1993

[54] MEANS AND METHOD FOR DETERMINING THE DEGREE OF WEAR OF A GAS INJECTION DEVICE

[75] Inventors: Manfred Winkelmann, Krefeld; Hans Rothfuss, Taunusstein; Herbert Metzger, Duisburg, all of Fed. Rep. of Germany

[73] Assignee: Didier-Werke AG, Wiesbaden, Fed. Rep. of Germany

[21] Appl. No.: 303,655

[22] Filed: Jan. 30, 1989

[30] Foreign Application Priority Data

Jan. 29, 1988 [DE] Fed. Rep. of Germany ..... 3802657

[51] Int. Cl.[5] ..... C21B 7/16

[52] U.S. Cl. ..... 266/47; 266/100; 266/220

[58] Field of Search ..... 266/45, 44, 78, 47, 266/220, 100, 99

[56] References Cited

U.S. PATENT DOCUMENTS 4,711,432 12/1987 Heinz et al. ..... 266/220

4,749,172 6/1988 Detalle et al. ..... 266/220

FOREIGN PATENT DOCUMENTS 3142989 11/1983 Fed. Rep. of Germany .

*Primary Examiner*—Scott Kastler

*Attorney, Agent, or Firm*—Wenderoth, Lind & Ponack

[57] ABSTRACT

A refractory gas permeable injection device for introducing gas into a metallurgical vessel containing molten metal has a surface to be exposed to and progressively worn away by the molten metal during operation of the vessel. The device includes an outer body and an inner body within the outer body, at least the inner body being formed of a fireproof refractory material. A gas permeable space extends through the device in the direction of wear thereof, and the space has a plurality of different geometric shapes spaced in such direction. Upon the metallurgical vessel being emptied, and with the device still relatively hot, gas is caused to flow through the space such that the gas will create on the surface an optically recognizable image in a particular geometric shape as a function of the relative degree of wear of the device.

24 Claims, 2 Drawing Sheets

MEANS AND METHOD FOR DETERMINING THE DEGREE OF WEAR OF A GAS INJECTION DEVICE

BACKGROUND OF THE INVENTION

The present invention relates to a gas purging or injection device formed of fireproof refractory ceramic material and employed for introducing a gas, such as argon or other inert gases, natural gas, air or oxygen, etc., into a metallurgical vessel containing molten metal. More particularly, the present invention relates to a means and method for determining the degree of wear of such a gas injection device. Further particularly, the present invention is directed to such a means and method whereby the degree of wear of the device may be determined by optical examination of a surface of the device that is exposed to and worn away by the molten metal during operation of the metallurgical vessel.

A gas purification, purging or injection device of this type is disclosed in German DE-PS 31 42 989. This prior art device is formed of two refractory bodies having different degrees of gas permeability and different emission capacities, i.e. different emissivities, such difference being greater than 0.1. To determine the degree of wear of the device, after the vessel is emptied and while the device still is hot, the brightnesses of the two bodies are optically examined and determined. As the device is worn away, different geometric shapes are detected as a result of different emissivities.

However, this known arrangement suffers from a number of inherent disadvantages. Thus, the number of refractory ceramic materials that are suitable for use in a gas injection device are limited. This selection is even further restricted by the requirement that the emissivities of the two bodies be greater than 0.1. The result is a very limited and restricted selection of refractory materials. Furthermore, the detection and evaluation of such slight differences in emissivity is subjective and/or technically very expensive. Furthermore, the differences in emissivity of such refractory materials are measurable only over a relatively narrow temperature range, thereby requiring optical examination at a relatively specific time.

SUMMARY OF THE INVENTION

With the above discussion in mind, it is an object of the present invention to provide an improved gas permeable injection device of the above type but including means for enabling the relative degree of wear of the device to determined by optical examination, wherein it is possible to overcome the above and other prior art disadvantages, as well as to provide an improved method of determining the relative degree of wear.

It is a more specific object of the present invention to provide such an improved means and method wherein the degree of relative wear of the device can be determined by optical examination that is largely independent of the particular materials forming the gas permeable injection device.

The above objects are achieved in accordance with the present invention by the provision of a gas permeable space extending throughout the injection device in the direction of wear thereof, the space having a plurality of different geometric shapes spaced in such direction. Gas is flowed through such space and will create on the worn surface of the device an optically recognizable image in a particular one of the geometric shapes as a function of the relative degree of wear of the device. The gas flowing through the space will be optically visible as a dark image due to relative cooling by the continuously flowing gas, and this dark image will contrast with the still hot and thus relatively brightly glowing refractory material of the gas injection device. This image will appear or be visible at the worn surface and will be of a particular geometric shape as a function of the wear of the refractory bodies of the device. With the space having different geometric shapes in the direction of wear, it will be easy to identify such shapes that will be definitive of the relative degree of wear of the device along the direction of wear. The different geometric shapes easily can be made to be so different that they are immediately distinguishable without doubt. The ability to recognize the relative degree of wear in accordance with the present invention is not dependent upon the particular materials used for the gas injection device, since relative emissivities are unimportant, in contrast to the above discussed prior art arrangement. Therefore, the present invention does not restrict the available refractory materials for use in the injection device. As a result, the concept of the present invention generally is applicable to various gas injection device constructions.

It is contemplated to be within the scope of the present invention that the structure be such that, by recognition of different geometric shapes, not only the relative degree of wear of the device is determinable, but also a state of relative wear such that the device should not be used further and should be replaced.

It is contemplated that in accordance with the present invention it is suitable if the space is designed such that at any state of wear the same amount of gas will flow through the space.

BRIEF DESCRIPTION OF THE DRAWINGS

Other objects, features and advantages of the present invention will be apparent from the following detailed description of preferred embodiments thereof, with reference to the accompanying drawings, wherein.

DETAILED DESCRIPTION OF THE INVENTION

Figure 1:
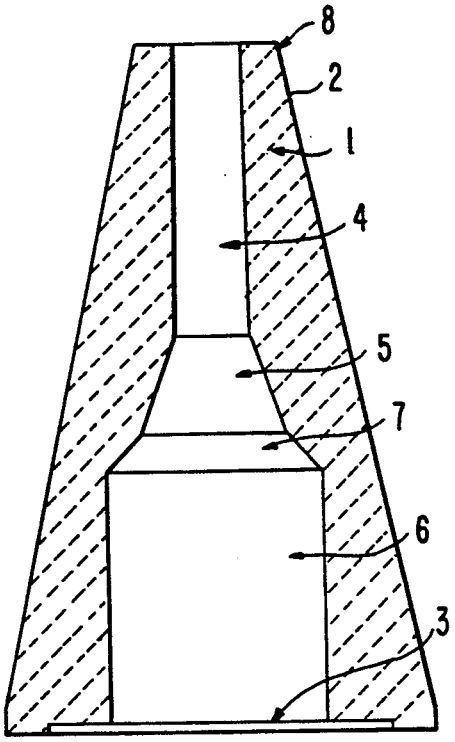
FIG. 1 is a longitudinal sectional view through an outer body of a gas permeable injection device in accordance with one embodiment of the present invention.
Figure 2:
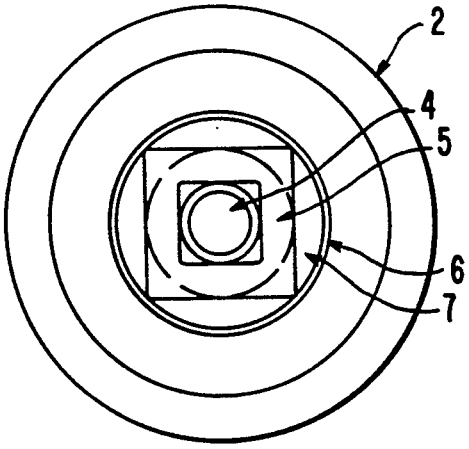
FIG. 2 is a bottom plan view of the device shown in FIG. 1.

With reference to FIGS. 1 and 2, an embodiment of a gas injection device in accordance with the present invention includes an outer body 1 of refractory material having a conically shaped outer surface 2. The device is adapted to be inserted, in a known manner, in a metallurgical vessel or an auxiliary device connected thereto, for example a sliding closure unit. Such vessel and device are not illustrated herein, as they are conventional, and it is contemplated that the concept of the present invention is employable in any such known manner. Within the interior of outer body 1 is formed a space 3. During use of a metallurgical vessel the device will be progressively worn away in a direction from an inner surface 8 of the device toward an outer surface thereof. Space 3 has a plurality of different geometric shapes spaced in the direction of wear. Thus, the upper or innermost section 4 of space 3 has a circular cylindrical configuration. The outermost or lower section 6 of space 3 also has a circular cylindrical configuration, but of a diameter substantially larger than section 4. Section 5, joined to the bottom of section 4, is conically square, and section 7, extending between sections 5 and 6 is a transition section between the square and circular configurations of sections 5 and 6. The refractory material of outer body 1 is relatively gas impermeable, and space 3 is filled with a gas permeable refractory material.

During use of the device, upon the metallurgical vessel being emptied and the refractory materials still being relatively hot, a gas is passed upwardly through space 3. Such gas will appear as a solid circular image if the device has not been worn beyond section 4, a square image of the device has been worn to section 5, a transition shape if the device has been worn to section 7, and a circular shape of a diameter substantially greater than section 4 if the device has worn to section 6. For example, if natural gas is injected through space 3, the solid image of the gas would be a flame image. If for example an inert gas such as argon were led through the space, then the solid image of the gas would appear as a dark area in contrast to the still glowing area of body 1. The recognition of the shape of the gas flow exiting from upper surface 8 will make it possible to correlate such shape to the relative longitudinal degree of wear of the device. This detection and determination is possible without any regard at all to the degrees of emissivity of the refractory materials employed, and specifically the materials are not required to have any particular relative degree of difference of emissivity.

It also is possible to insert an inner refractory body into the space 3 within outer body 1. The space 3 then would be formed by an open gap between the inner surface of outer body 1 and the outer surface of such inner body. When gas is passed through such space, then the gas would be visible as an annularly shaped flame image or dark image of the various different geometrical configurations.

Figure 3:
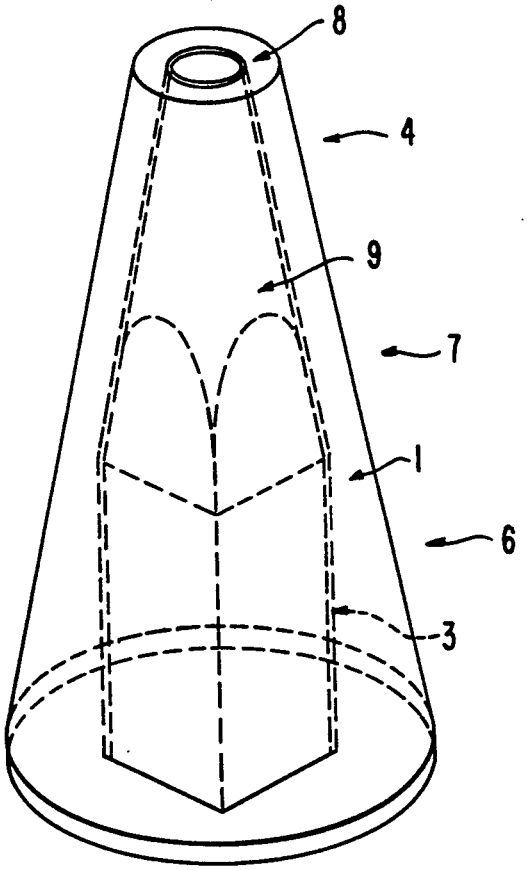
FIG. 3 is a perspective view of another embodiment of the device according to the present invention.

An example of such an arrangement in accordance with the present invention will be discussed with reference to FIGS. 3–4c, but illustrating different geometrical configurations than in the embodiment of FIGS. 1 and 2. Thus, in FIG. 3 is shown an outer refractory body 1 having therein an inner refractory body 9. Between the inner body 9 and the outer body 1 is a space 3 in the form of an open, gas permeable gap. It is contemplated that the distance between the inner surface of the outer body and the outer surface of the inner body 9 is the same in all areas of gap 3. In upper section 4 the space 3 is in the shape of a truncated cone, and in a lower section 3 the space is shaped as a square. Between sections 4 and 6 is a transition section 7. It will be apparent that outer body 1 has a corresponding inner configuration and inner body 9 has a corresponding outer configuration to define therebetween space 3.

Figure 4A:
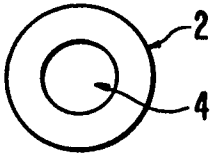
FIGS. 4*a*–4*c* are schematic views from above of the appearance of the upper surface of the device shown in FIG. 3, at three different relative degrees of wear thereof.
Figure 4B:
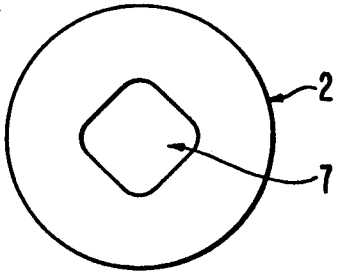
Figure 4C:
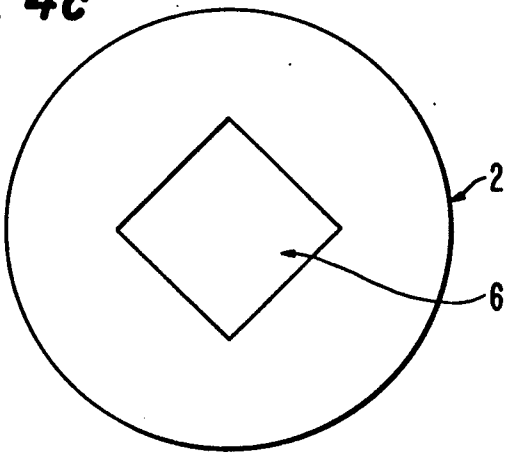

In use of the device, without any wear thereof, gas flowing through space 3 will be optically visible on surface 8 in the form of a flame image or dark image of circular shape, as shown in FIG. 4*a*. When wear has advanced to transition section 7, then the image on the top surface 8 will be of a square shape with rounded corners as shown in FIG. 4*b*. When wear of the device has advanced to lower section 6, the gas image on the top surface will be square-shaped with sharp corners as shown in FIG. 4c.

It will be understood that in the embodiment of FIG. 1 the body 1 will be formed of a gas impermeable, or substantially impermeable, refractory material. Similarly, in the embodiment of FIG. 3 the bodies 1 and 9 will be formed of substantially gas impermeable refractory materials.

Figure 5:
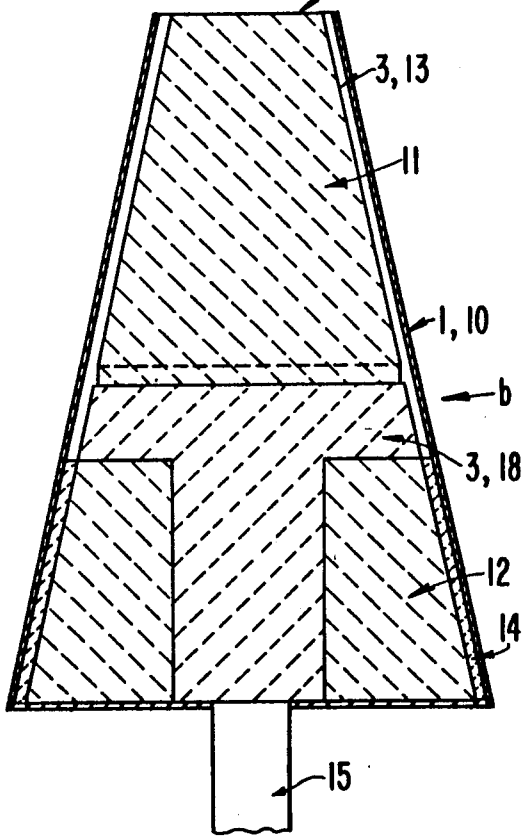
FIG. 5 is a schematic longitudinal sectional view of a device in accordance with a further embodiment of the present invention.

In the device of FIG. 5, the outer body 1 is in the form of a metal, for example sheet metal, jacket or mantle 10. The inner body is in the form of an upper refractory member 11 and a lower refractory member 12, both formed of relatively gas impermeable refractory materials. The space 3 is in the form of an open gap between the inner surface of jacket 10 and the outer surface of upper refractory member 11. Space 3 also extends through lower refractory member 12 and separates the upper and lower refractory members 11, 12. This portion of space 3 is filled with a highly gas permeable refractory material 18, for example having a permeability of more than 50 nPm. In contrast, upper and lower refractory members 11, 12 are formed of a dense or weakly gas permeable refractory material The metal jacket 10 is shrunk onto the outer surface of lower refractory member 12 or may be tightly joined thereto by means of a refractory mortar joint 14.

In use of the device of FIG. 5, upon the metallurgical vessel being emptied and while the refractory materials still are relatively hot, gas is led through a gas line 15 into the portion of space 3 filled by gas permeable refractory material 18. The gas flows from there through open gap 13 and exits on upper surface 8 in the form of a dark circle due to the cooling effect of the gas, compared with the lighter surface 8 of the still hot refractory material of member 11. If the wear of the device advances to the area b, whereat all of the upper refractory member 11 has been consumed, then the gas image will appear as a solid dark circular spot. This is an indication that the wear has advanced to such a degree that the gas injection device should be replaced. Prior to such degree of wear, the relative size of the circular image is an indication of the relative degree of wear of the device.

Figure 6:
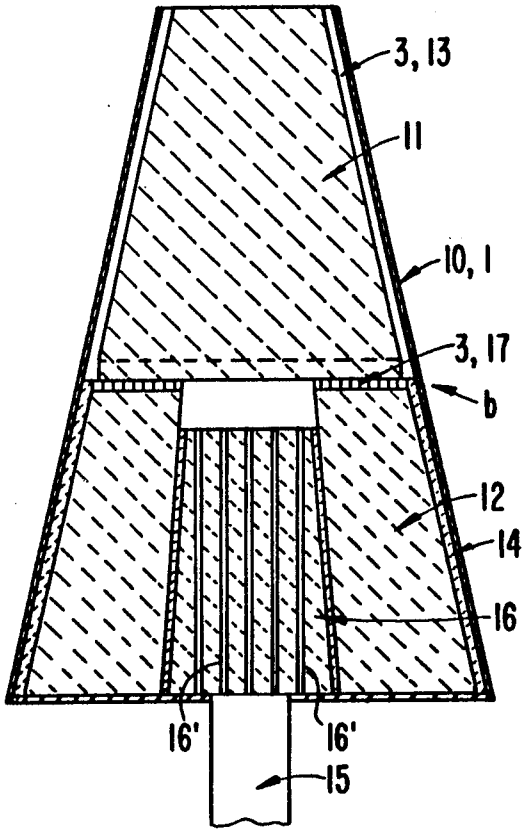
FIG. 6 is a view similar to FIG. 5 but of a still further embodiment of the present invention.

The embodiment of FIG. 6 is substantially similar to the embodiment of FIG. 5. However, extending through lower refractory member 12 is a refractory insert 16 having therethrough capillary gas permeable passages 16'. This replaces the gas permeable material 18 extending through the lower refractory member in the embodiment of FIG. 5. Furthermore, between the upper and lower refractory members 11, 12 are gas channels 17 that extend radially outwardly, for example in a star-like shape. During use of the device, upon the wear advancing to level b, the visible gas image would be in the form of a dark star shape. Otherwise, the embodiment of FIG. 6 is similar to the embodiment of FIG. 5.

Although the present invention has been described and illustrated with respect to preferred embodiments thereof, it is to be understood that various modifications and changes may be made to the specifically described and illustrated features without departing from the scope of the present invention.

We claim:

1. In a gas permeable injection device for introducing gas into a metallurgical vessel containing molten metal, said device having a surface to be exposed to and progressively worn away by the molten metal during operation of the vessel, said device including an outer body and an inner body within said outer body, at least said inner body being formed of a fireproof refractory material, the improvement comprising means for enabling the relative degree of wear of said device to be determined by optical examination of said surface, said means comprising:

a gas permeable space extending throughout said device in the direction of wear thereof, said space having a plurality of different geometric shapes spaced in said direction; and means for, after the metallurgical vessel has been emptied of molten metal, passing gas through said space such that said gas exits from said surface as an optically recognizable image in a particular said geometric shape as a function of the relative degree of wear of said device.

2. The improvement claimed in claim 1, wherein said space comprises, at least for a portion of the length of said device in said direction, an open gap between an inner surface of said outer body and an outer surface of said inner body.

3. The improvement claimed in claim 2, wherein said space comprises said open gap throughout the entire said length.

4. The improvement claimed in claim 3, wherein said open gap is of substantially uniform thickness throughout said length.

5. The improvement claimed in claim 1, wherein said space comprises, at least for a portion of the length of said device in said direction, a gas permeable refractory member.

6. The improvement claimed in claim 5, wherein said gas permeable refractory member comprises said inner body and extends throughout the entire said length.

7. The improvement claimed in claim 5, wherein said outer body comprises a metal jacket, and said inner body comprises an upper refractory member and a lower refractory member.

8. The improvement claimed in claim 7, wherein said gas permeable refractory member extends through said lower refractory member.

9. The improvement claimed in claim 7, wherein said gas permeable refractory member extends through said lower refractory member and spaces said upper refractory member from said lower refractory member.

10. The improvement claimed in claim 7, wherein said space further comprises an open gap between an inner surface of said metal jacket and an outer surface of said upper refractory member.

11. The improvement claimed in claim 1, wherein said image is optically recognizable on said surface as a flame image upon gas flowing through said space.

12. The improvement claimed in claim 1, wherein said image is optically recognizable on said surface as a dark zone upon gas flowing through said space.

13. A method of determining the relative degree of wear of a gas permeable injection device used for introducing gas into a metallurgical vessel containing molten metal, wherein a surface of the device exposed to the molten metal is progressively worn away thereby, said method comprising:

providing said device with a gas permeable space extending throughout said device in the direction of wear thereof, such that said space has a plurality of different geometric shapes spaced in said direction; and upon emptying of the metallurgical vessel, passing gas through said space such that said gas exits said device from said surface thereof as an optically recognizable image in a particular said geometric shape as a function of the relative degree of wear of said device.

14. A method as claimed in claim 13, wherein said providing comprises defining said space, at least for a portion of the length of said device in said direction, as an open gap between an inner surface of an outer body of said device and an outer surface of an inner body of said device.

15. A method as claimed in claim 14, comprising defining said space as said open gap throughout the entire said length.

16. A method as claimed in claim 15, comprising defining said open gap to be of substantially uniform thickness throughout said length.

17. A method as claimed in claim 13, wherein said providing comprises defining said space, at least for a portion of the length of said device in said direction, as a gas permeable refractory member.

18. A method as claimed in claim 17, comprising providing said gas permeable refractory member to extend throughout the entire said length.

19. A method as claimed in claim 17, further comprising forming said device as an outer body in the form of a metal jacket and an inner body in the form of an upper refractory member and a lower refractory member.

20. A method as claimed in claim 19, comprising providing said gas permeable refractory member to extend through said lower refractory member.

21. A method as claimed in claim 19, comprising providing said gas permeable refractory member to extend through said lower refractory member and to space said upper refractory member from said lower refractory member.

22. A method as claimed in claim 19, wherein said providing further comprises defining said space as an open gap between an inner surface of said metal jacket and an outer surface of said upper refractory member.

23. A method as claimed in claim 13, comprising optically observing said image on said surface as a flame image upon said gas flowing through said space.

24. A method as claimed in claim 13, further comprising optically observing said image on said surface as a dark zone upon said gas flowing through said space.

* * * * *